US005618171A

United States Patent [19]

von Behr et al.

[11] Patent Number: 5,618,171

[45] Date of Patent: Apr. 8, 1997

[54] SUPPLY UNIT WITH A CERAMIC INTERNAL GEAR PUMP

[75] Inventors: Diedrich von Behr, Hochdorf; Gerald Kalbe, Plochingen, both of Germany

[73] Assignee: Cerasiv GmbH Innovatives-Keramik-Engineering, Plochingen, Germany

[21] Appl. No.: 375,880

[22] Filed: Jan. 20, 1995

[30] Foreign Application Priority Data

Jan. 21, 1994 [DE] Germany ..... 44 01 783.9

[51] Int. Cl.[6] ..... F04C 2/10; F04C 15/00

[52] U.S. Cl. ..... 418/152; 418/171

[58] Field of Search ..... 418/152, 166, 418/171

[56] References Cited

U.S. PATENT DOCUMENTS

| | | | |
|---|---|---|---|
| 3,552,895 | 1/1971 | Bayley | 418/152 |
| 3,881,849 | 5/1975 | Commarmot et al. | 418/152 |
| 4,969,806 | 11/1990 | Nusser | 418/171 |
| 5,156,540 | 10/1992 | Fernau et al. | 418/152 |
| 5,199,971 | 4/1993 | Akechi | 418/171 |
| 5,226,798 | 7/1993 | Eisenmann | 418/152 |

FOREIGN PATENT DOCUMENTS

| | | | |
|---|---|---|---|
| 0464261 | 12/1990 | European Pat. Off. . | |
| 2163935 | 7/1973 | France . | |
| 2010659 | 9/1970 | Germany . | |
| 2312263 | 9/1974 | Germany . | |
| 60-6092 | 1/1985 | Japan | 418/152 |
| 60-128983 | 7/1985 | Japan | 418/171 |
| 1147177 | 6/1989 | Japan | 418/171 |
| 2102388 | 4/1990 | Japan | 418/152 |
| 9215785 | 9/1992 | WIPO . | |

*Primary Examiner*—John J. Vrablik
*Attorney, Agent, or Firm*—Felfe & Lynch

[57] ABSTRACT

Disclosed is a fluid delivery supply unit having an internal gear pump as a pump unit, with a bearing race in which a driven inner gear is arranged on a bearing journal and the inner gear rotates with it by way of toothing engagement with an outer gear arranged between the inner gear and the bearing race, and the inner gear has one tooth fewer than the outer gear so that a pumping action is produced. A low noise level, resistance to corrosion, and a reduced weight, are obtained by forming parts of the internal gear pump, such as the bearing race, inner gear or outer gear, of a ceramic material.

4 Claims, 1 Drawing Sheet

SUPPLY UNIT WITH A CERAMIC INTERNAL GEAR PUMP

BACKGROUND OF THE INVENTION

The present invention is a supply unit for delivering fluids. Such supply units generally have an internal gear pump, as a pump unit, with a bearing race in which a driven inner gear is arranged on a bearing journal. An outer gear, arranged between the inner gear and the bearing race, rotates with the inner gear by way of toothing. The inner gear has one tooth fewer than the outer gear so that a pumping action is produced.

WO 92/15 785 A1 shows a supply unit for delivering fluids in which the pump unit is an internal gear pump. The internal gear pump, also known as a "gerotor" consists of a bearing race in which an inner gear is rotatably arranged on a bearing journal. The bearing journal, and with it the inner gear, is driven by a motor. An outer gear is arranged between the inner gear and the bearing race and is rotated by, and with, the inner gear. The inner gear is provided with one tooth fewer than the outer gear, so that a pumping action is produced. All parts of the internal gear pump, such as the bearing race, inner gear and outer gear, consist of metal.

In the above-mentioned WO 92/15 785 A1, at least parts of the multi-part pump housing are produced from a ceramic material. It is intended that the generation of noise should thereby be reduced.

EP 0 464 261 A1 shows a supply unit, especially for delivering motor fuel, with an electric drive motor and a pump unit ("gerotor") coupled thereto which comprises a base plate, an intermediate plate with a cut-out for the rotating pump parts, and a cover. In this case at least the base plate and the cover consist of a ceramic material, the end faces, nearer the intermediate plate, of the base plate and of the cover having ground surfaces.

Objectives underlying the present invention include constructing a supply unit of the above generally described type so that it has a low noise level and is corrosion-resistant. An additional objective is to provide a supply unit having a reduced weight.

The various features of novelty which characterize the invention are pointed out with particularity in the claims annexed to and forming a part of this specification. For a better understanding of the invention, its operating advantages and specific objects obtained by its use, reference should be had to the accompanying drawings and descriptive matter in which there is illustrated and described a preferred embodiment of the invention.

THE INVENTION

According to the invention, the above objectives are obtained in that at least parts of the internal gear pump, such as the bearing race, inner gear or outer gear, are of a ceramic material.

Due to the use of ceramic parts in the internal gear pump, the supply unit not only has a considerably lower noise level, but it also is corrosion-resistant with respect to the media being delivered. Noise levels are especially disturbing when the pump is advantageously used in a motor vehicle for delivering motor fuel from a supply tank to the engine, since in this case the noise is amplified by way of the fuel tank and/or the vehicle bodywork.

Advantageously, all parts of the internal gear pump, that is to say, the bearing race, inner gear and outer gear, are formed of a ceramic material. Such a construction results in a weight reduction of the unit of approximately 40% compared with an internal gear pump of metal.

A further substantial reduction in noise level and an improvement in running properties are obtained by forming the surfaces of the tooth contours of the inner gear and outer gear by means of typical close-to-contour shaping methods. Such methods include, for example, finish pressing or injection molding. Such an embodiment allows the advantages of the natural sinter skin, in the case of ceramic materials, to be utilized to the fullest extent, such as the even surface structure. A grinding process of the gear teeth contours would significantly impair the running and noise properties.

In a preferred embodiment, the ceramic material is an aluminum oxide or silicon carbide or mixtures thereof.

Figure 1:
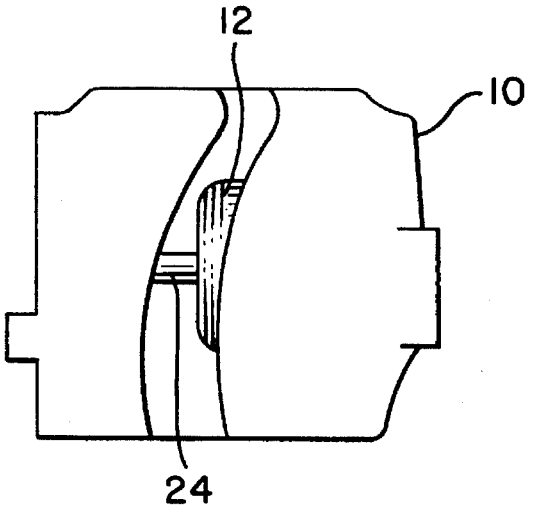
FIG. 1 shows a pump and motor arrangement.
Figure 2:
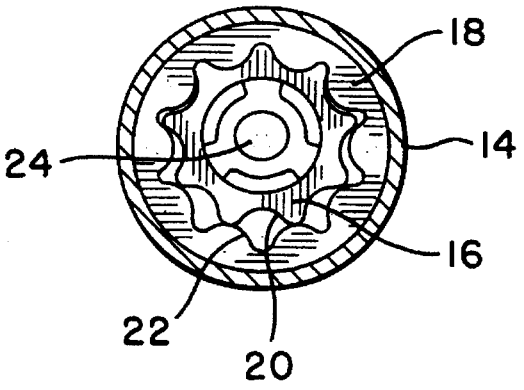
FIG. 2 shows a bearing race, outer and inner gears and bearing journal used in the internal gear pump of FIG. 1.

Referring to the drawings, FIG. 1 schematically shows the arrangement of an internal gear pump 10 and motor 12. The internal gear pump includes, as shown in FIG. 2, a bearing race 14, an inner gear 16 and an outer gear 18 which are formed of the ceramic material. The inner gear and outer gear each have tooth contours 20 and 22, respectively, as described above. The inner gear 16 has one tooth fewer than the outer gear 18. The inner gear is arranged on a bearing journal 24 and is driven by motor 12.

Figure 3:
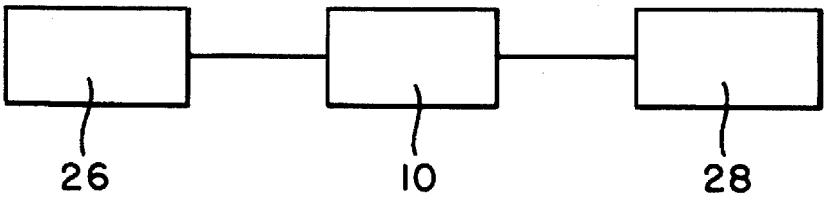
FIG. 3 shows an arrangement for delivery of motor fuel oil from a supply tank to a motor vehicle using the pump of FIG. 1.

FIG. 3 generally shows schematically a fuel supply tank 26, a gear pump 10 (having the bearing race, the inner and outer gear and bearing journal as shown in FIG. 2) and generally depicts a motor 28 vehicle to which the fuel is supplied via the gear pump 10.

It will be understood that the specification and examples are illustrative but not limitative of the present invention and that other embodiments within the spirit and scope of the invention will suggest themselves to those skilled in the art.

What is claimed is:

1. A fluid delivery supply unit comprising:

an internal gear pump as a pump unit having a bearing race in which an inner gear is arranged on a bearing journal and is driven by a motor;

an outer gear arranged between the inner gear and the bearing race and adapted to rotate with the inner gear by way of toothing, the inner gear having one tooth fewer than the outer gear to provide a pumping action in operation, each tooth of the inner gear and outer gear having a contoured surface treated by a close-to-contour shaping method and having a natural sinter skin, wherein each of said bearing race, inner gear and outer gear of the internal gear pump is comprised of a ceramic material and the close-to-contour shaping method is at least one selected from finish pressing or injection molding.

2. The fluid delivery supply unit of claim 1 wherein the ceramic material is aluminum oxide.

3. The fluid delivery supply unit of claim 1 wherein the ceramic material is silicon carbide.

4. The fluid delivery supply unit of claim 1 wherein the supply unit is used to delivery motor fuel from a supply tank to the engine of a motor vehicle.

* * * * *